US008881953B2

(12) United States Patent
Dennis

(10) Patent No.: US 8,881,953 B2
(45) Date of Patent: Nov. 11, 2014

(54) BOTTLE WITH INTEGRAL DIP TUBE

(75) Inventor: Stephen R. Dennis, Danville, CA (US)

(73) Assignee: The Clorox Company, Oakland, CA (US)

( * ) Notice: Subject to any disclaimer, the term of this patent is extended or adjusted under 35 U.S.C. 154(b) by 131 days.

(21) Appl. No.: 13/609,056

(22) Filed: Sep. 10, 2012

(65) Prior Publication Data

US 2014/0069962 A1 Mar. 13, 2014

(51) Int. Cl.
*B67D 7/58* (2010.01)

(52) U.S. Cl.
USPC ..... 222/382; 222/383.1; 222/464.1; 239/333

(58) Field of Classification Search
CPC ..... B05B 11/0056; B05B 11/3009; B05B 11/3011; B05B 11/3057; B05B 11/303
USPC ..... 222/207, 211, 382, 383.1, 321.7–321.9, 222/464.1; 239/333
See application file for complete search history.

(56) References Cited

U.S. PATENT DOCUMENTS

| | | | | |
|---|---|---|---|---|
| 4,863,071 | A | 9/1989 | Guss et al. | |
| 5,246,146 | A | 9/1993 | Bartimes et al. | |
| 5,303,851 | A * | 4/1994 | Libit et al. | 222/207 |
| 5,337,928 | A | 8/1994 | Foster et al. | |
| 5,638,994 | A * | 6/1997 | Libit et al. | 222/207 |
| 6,702,157 | B1 | 3/2004 | Dobbs | |
| 7,325,706 | B2 | 2/2008 | Sweeton et al. | |
| 7,478,739 | B2 | 1/2009 | Foster | |
| 7,490,743 | B2 | 2/2009 | Herzog | |
| 2010/0096415 | A1 | 4/2010 | Dennis | |
| 2011/0036927 | A1 | 2/2011 | Hensen | |
| 2011/0108447 | A1 | 5/2011 | Hoefing et al. | |
| 2011/0108581 | A1 | 5/2011 | Dennis | |

* cited by examiner

*Primary Examiner* — Kevin P Shaver
*Assistant Examiner* — Nicholas J Weiss
(74) *Attorney, Agent, or Firm* — Erin C. Collins

(57) ABSTRACT

Fluid dispensing apparatus with integral dip tube. Container includes body having wall defining interior volume, a first neck top, and a fitment extending from the neck top. A dip tube integrally formed to the body, fluidly connected to interior bottom, and fluidly connected to interior volume at landing top edge at or below the neck top, wherein distance between landing top edge and neck top is equal to or less than length of the fitment. The landing may be funnel-shaped, with one or more sides of landing slanting inward towards top opening of dip tube. Dispenser may be coupled to fitment and include supply line connected with dip tube at landing. Bent connector may be provided for fluidly connecting supply line with dip tube at landing when dispenser is attached to neck top. Container may include second neck top separated from first neck top by gap.

9 Claims, 11 Drawing Sheets

BOTTLE WITH INTEGRAL DIP TUBE

BACKGROUND

1. Field of the Invention

Embodiments of the present disclosure relate to containers and fluid withdrawing assemblies for liquids, such as liquid cleaners and the like. More particularly, embodiments of the present disclosure relate to containers having an integral dip tube formed therein. In particular, embodiments of the present invention relate to the connection of a trigger-type sprayer to a bottle with a snap-on fitment and connection to an integral dip tube.

2. Description of the Related Art

Trigger sprayers are those types of sprayers that can be held in a single hand of the user and operated by the fingers of the user's hand to pump fluid from a container connected to the trigger sprayer. A trigger sprayer typically includes s sprayer housing that contains a pump chamber and piston, and a sprayer fluid supply passageway that fluidly communicates a fluid inlet opening (sometimes also referred to as a "connector aperture") with the pump chamber.

A dip tube is often sealingly coupled to the connector aperture, and extends through a neck of a container and into fluid contents of the container. The dip tube fluidly communicates the container with the fluid supply passageway of the sprayer housing.

SUMMARY OF THE INVENTION

The present disclosure provides a fluid dispensing container comprising a body having a wall defining an interior volume, a neck top, and a fitment extending from the neck top. The neck top and the fitment may have a substantially continuous circular shape. The container may further comprise a dip tube integrally formed to the body, fluidly connected to the interior volume at a bottom of the interior volume, and fluidly connected to the interior volume at a landing at or below the neck top, wherein a distance between the landing and the neck top is equal to or less than a length of the fitment. The dip tube may be separated from the wall by a partition.

The fitment may comprise a snap-fit fitment or a threaded fitment. The fitment may be configured to continuously encircle the body below the neck top.

The landing may be disposed substantially level with the neck top, substantially level with a bottom end of the fitment, or between the neck top and a bottom end of the fitment.

The landing may be funnel-shaped, with one or more sides of the landing slanting inward towards a top opening of the dip tube.

The container may further comprise a dispenser including a connector configured to couple to the fitment and to fluidly connect to the dip tube at the landing. The dispenser may include a supply line directly connected with the dip tube when the dispenser is attached to the neck top. The container may further comprise a bent connector fluidly connecting the supply line with the dip tube at the landing when the dispenser is attached to the neck top.

The present disclosure also provides a fluid dispensing container comprising a body having a wall defining an interior volume, a first neck top, and a second neck top separated from the first neck top by a gap. The container may further comprise a dip tube integrally formed to the body, fluidly connected to the interior volume at a bottom of the interior volume, and fluidly connected to the interior volume at a landing at or below the first neck top. A fluid dispenser may be coupled to the first neck top.

The container may comprise a fitment below the first neck top. The fitment may comprise a threaded fitment or a snap-fit fitment.

The distance between the landing and the first neck top may be equal to or less than a length of the fitment.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF THE EMBODIMENTS

Figure 1:
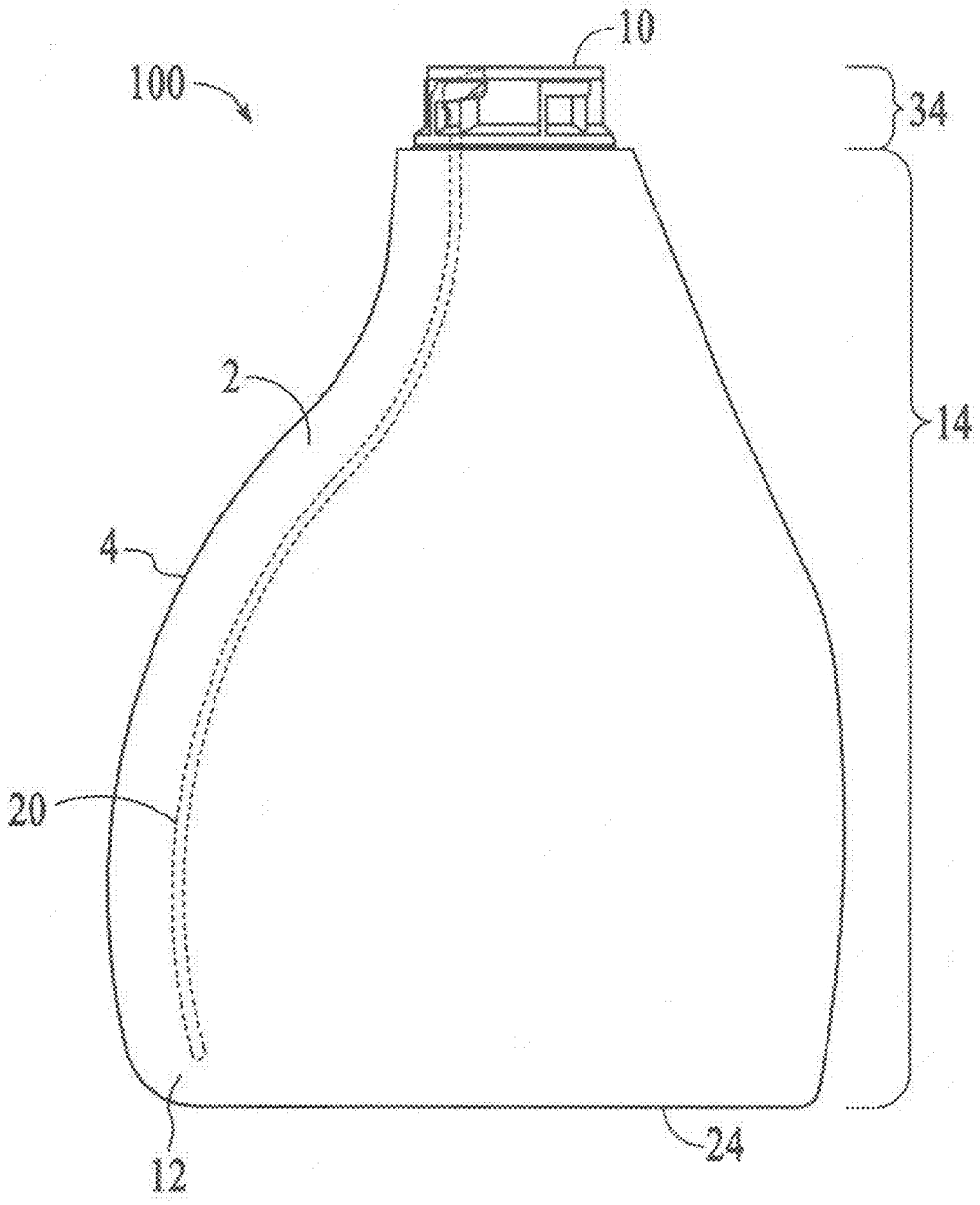
FIG. 1 shows a side elevation view of a fluid dispensing container, in accordance with various embodiments of the present disclosure.

Reference will now be made to the drawings wherein like numerals refer to like parts throughout. For ease of description, the components of embodiments of the present invention are described in the normal (upright) operating position, and terms such as upper, lower, horizontal, etc., are used with reference to this position. It will be understood, however, that the components of embodiments of the present invention may be manufactured, stored, transported, used, and sold in an orientation other than the position described.

Figures illustrating the components of embodiments of the present invention show some conventional mechanical elements that may be known and that may be recognized by one skilled in the art. The detailed descriptions of such elements that are not necessary to an understanding of the invention, and accordingly are herein presented only to the degree necessary to facilitate an understanding of the novel features of the present invention.

As used herein and in the appended claims, the term "comprising" is inclusive or open-ended and does net exclude additional unrecited elements. compositional components, or method steps. Accordingly, the term "comprising" encompasses the more restrictive terms "consisting essentially of" and "consisting of."

It must be noted that, as used in this specification and the appended claims, the singular forms "a," "an," and "the" include plural references unless the content clearly dictates otherwise. Similarly, the use of substantially any plural terms herein may be translated by those having skill in the art from the plural to the singular as is appropriate to the context and/or application. The various singular/plural permutations may be expressly set forth herein for sake of clarity.

In those instances where a convention analogous to "at least one of A, B, and C, etc." is used, in general such a construction is intended in the sense one having skill in the art would understand the convention (e.g., "an apparatus having at least one of A, B, and C" would include but not be limited to apparatuses that have A alone, B alone, C alone, A and B together, A and C together. Band C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 elements refers to groups having 1, 2, or 3 elements. Similarly, a group having 1-5 elements refers to groups having 1, 2, 3, 4, or 5 elements, and so forth.

Unless defined otherwise, all technical and scientific terms used herein have the same meaning as commonly understood by one of ordinary skill in the art to which embodiments of the present invention pertain. Although a number of methods and materials similar or equivalent to those described herein can be used in the practice of the present invention, the preferred materials and methods are described herein.

The term "container" or "bottle," as used herein, means and includes any container for holding a fluid material. A container or bottle may be made of any suitable material, depending upon the product therein. For example, a container or bottle may be made of plastic.

The term "integral dip tube", as used herein, means and includes any channel formed integrally along the structure of a bottle that may carry the fluid present in the bottle. An integral dip tube may be a channel formed in a bottle running from near a top opening in the bottle, along a side wall of the bottle, and ending near the bottom interior of the bottle.

Sprayer connectors with conventional dip tubes may present various problems. Warped dip tubes are currently a major problem in the pump/bottle assemblies with a resultant undesired amount of scrap. The elimination of the conventional dip tube may eliminate this major problem. By eliminating the conventional dip tube, the problem of the dip tube otherwise becoming separated from the pump is no longer an issue. Further, when the container is of the refillable type and the pump is to be removed from the container, with the elimination of the dip tube, there is no column of fluid remaining with the pump that can dribble during refill as may otherwise occur in containers with conventional dip tubes.

Broadly, embodiments of the present invention provide containers and fluid withdrawing assemblies for liquids. The container may include a body having a wall defining an interior volume, at least a first neck top, and a fitment below the neck top. A dip tube may be integrally formed to the body, fluidly connected to the interior volume at a bottom of the interior volume, and fluidly connected to the interior volume at a landing at or below the neck top, wherein a distance between the landing and the neck top is equal to or less than a length of the fitment. The landing may be funnel-shaped, with one or more sides of the landing slanting inward towards a top opening of the dip tube. A dispenser may be coupled to the fitment of the container and may include a supply line configured to connect with the dip tube at the landing. A bent connector may be provided for fluidly connecting the supply line with the dip tube at the landing when the dispenser is attached to the neck top. A container may include a second neck top separated from the first neck top by a gap.

Figure 2:
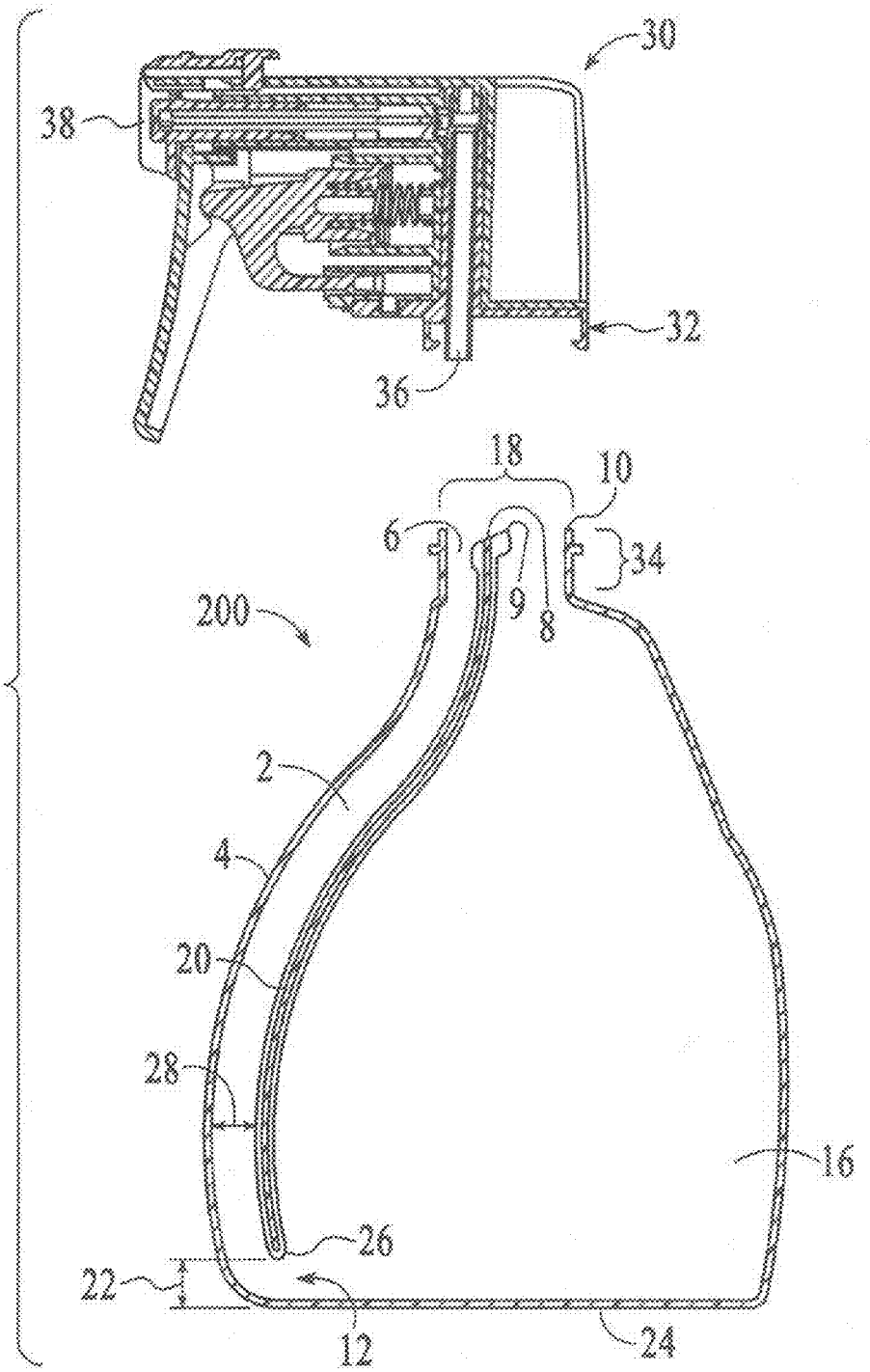
FIG. 2 shows a sectional plan view of the container of FIG. 1.

Referring to FIG. 1, there is shown a side elevation view of an example container 100 in accordance with various embodiments of the present disclosure. FIG. 2 shows a sectional plan view of a similar container 200. The containers 100, 200 may include a dip tube 2, shown in hashed lines in FIG. 1. The dip tube 2 may be formed as a channel along the body 14 of the container 100, 200. The dip tube 2 may extend along the wall 4 from a top opening 6 at a landing 8 at the neck top 10 of the container 100, 200 to a bottom opening 12 near the bottom 24 of the container 100, 200. The landing 8 may be funnel shaped, either round or oval, rather than being flat, with one or more sides of the landing 8 slanting inwards towards the circular dip tube top opening 6 below the landing top edge 9.

As shown in FIG. 1 and FIG. 2, the wall 4 of the container 100, 200 may define an interior volume 16. The neck top 10 may define an opening 18 providing access to the interior volume 16 and to the dip tube 2. A partition wall 20 may separate, in part, the dip tube 2 from the interior volume 16.

The dip tube 2 may stop a distance 22 from the bottom of the container 100, 200 so as to be in fluid communication with the interior volume 16 of the container 100, 200. The distance 22 between the bottom end 26 of the partition wall 20 and the bottom 24 of the container 100, 200 may be selected so that a bottom end 26 of the partition wall 20 is close enough to the bottom 24 of the container 100, 200 such that fluid in the interior volume 16 of the container 100, 200 may be taken up through the dip tube 2. The distance 22 may be further selected so that the bottom end 26 of the partition wall 20 is not too far from the bottom 24 of the container 100, 200 such that substantially all of fluid in the container 100 is taken up through the dip tube 2. Typically, the distance 22 may be from about 0.5 to about 3 times a diameter 28 of the dip tube 2.

In various embodiments, the landing 8 may be formed at or below the neck top 10, and such that the distance between the neck top 10 and the landing 8 may be equal to or less than a length of a fitment 34 of the container. As illustrated in FIG. 1 and FIG. 2, for example, the landing 8 may be located approximately even with the neck top 10. In other embodiments, the landing 8 may be located between the neck top 10 and the bottom of the fitment 34 (shown for the container 300 in FIG. 3) or substantially even with the bottom of the fitment 34 (shown for the container 400 in FIG. 4).

The container 200 may be coupled to a fluid dispenser. The fluid dispenser 30 may be a trigger-type dispenser as shown, a pump-type dispenser, or another type of fluid dispenser. The fluid dispenser 30 may include an exit port 38, an attachment connector 32, and a supply line 36. The supply line 36 may comprise a flexible connector tube that can be fluidly connected by interference fit to the top opening 6 of the dip tube 2 within the funnel shaped landing 8 and below the landing top edge 9. In the illustrated configuration, the dip tube 2 is disposed on the same side as the exit port 38 of the fluid dispenser 30. This configuration may be especially useful when the fluid from the container 100 is expelled therefrom by pointing the fluid dispenser 30 downward. In this downward pointing configuration, a small amount of fluid may pool near the bottom opening 12 of the dip tube 2, thereby allowing even this small amount of fluid to be drawn up the dip tube 2. Other configurations may also be useful. For example, for a container 100 that is typically used by pointing the exit port 38 of the fluid dispenser 30 upwards, the dip tube 2 may be formed at an opposite side of the exit port 38 (not shown).

Figure 3:
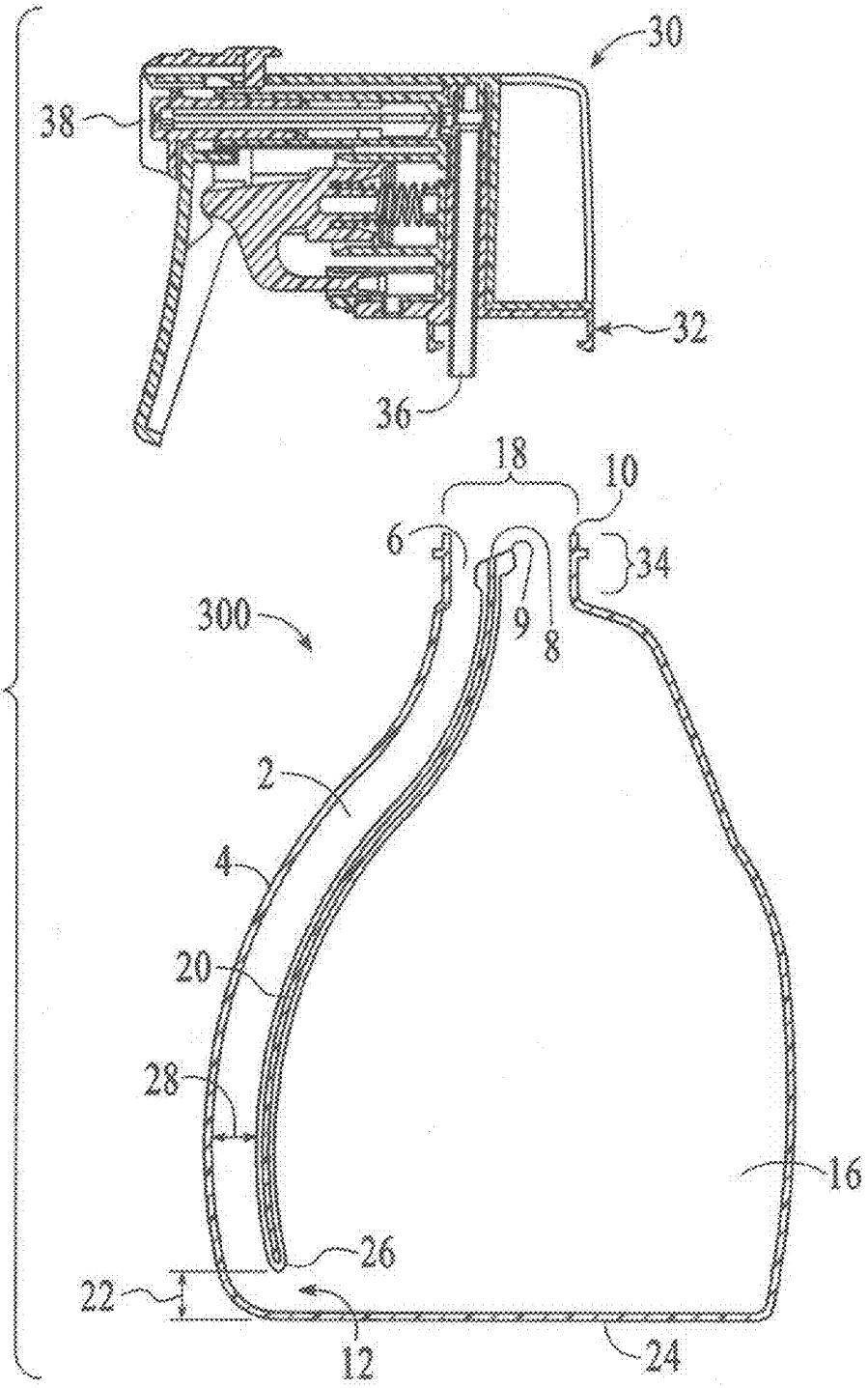
FIG. 3 shows a sectional plan view of another fluid dispensing container, in accordance with various embodiments of the present disclosure.
Figure 4:
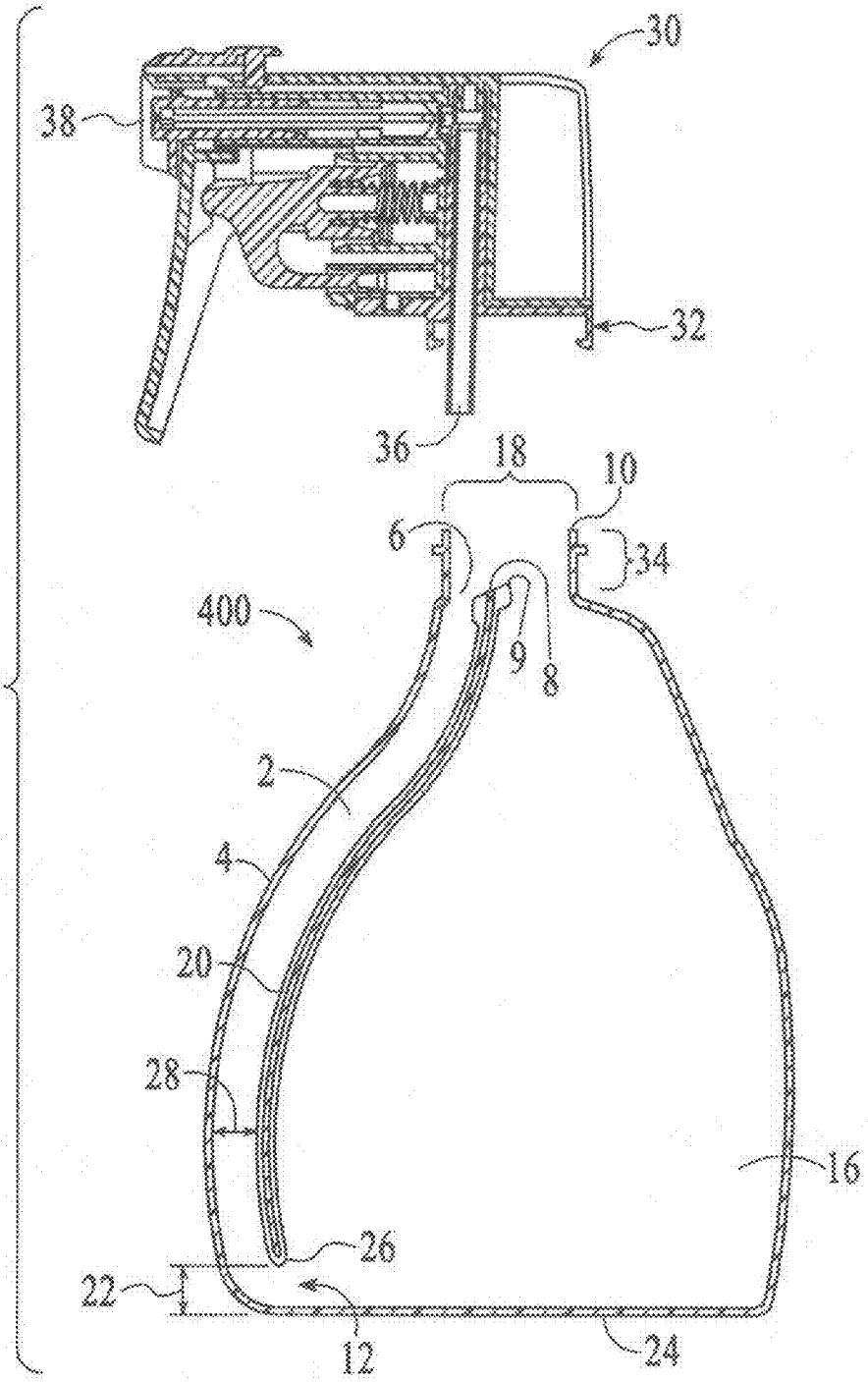
FIG. 4 shows a sectional plan view of yet another fluid dispensing container, in accordance with various embodiments of the present disclosure.
Figure 5:
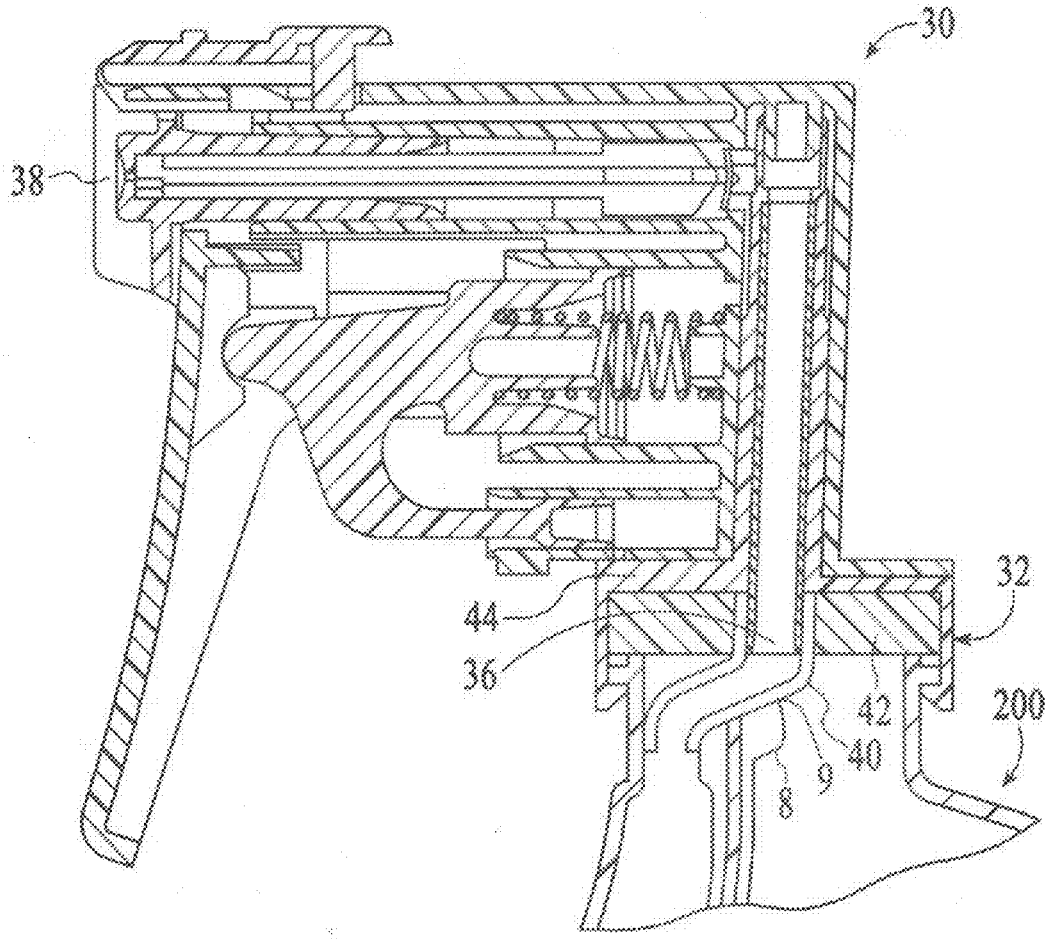
FIG. 5 shows a fragmentary sectional plan view of the fluid dispensing container of FIG. 2 and a fluid dispenser, in accordance with various embodiments of the present disclosure.
Figure 6:
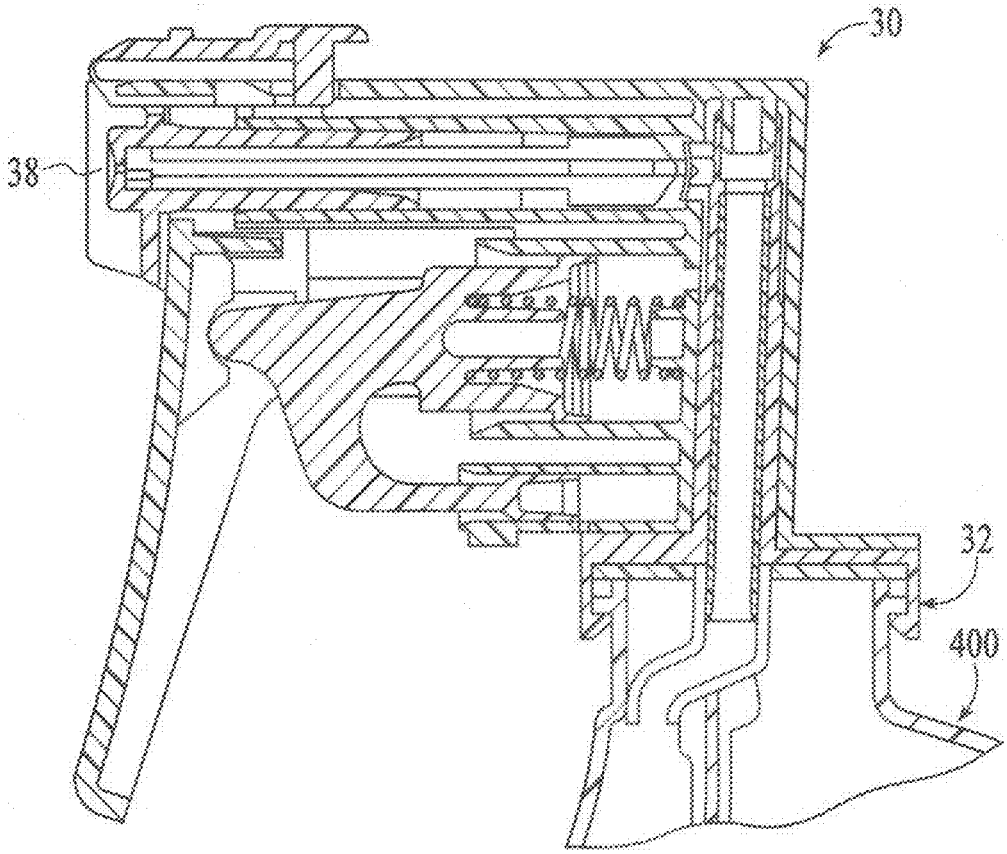
FIG. 6 shows a fragmentary sectional plan view of the fluid dispensing container of FIG. 4 and another fluid dispenser, in accordance with various embodiments of the present disclosure.

The supply line 36 of the fluid dispenser 30 may be bested such that the supply line 36 substantially lines up and provides an interference fit with the opening 6 of the dip tube 2 as illustrated in FIGS. 2-4, or may located elsewhere. The supply line 36 may be located, for example, along the center axis of the opening 18, as with many conventional fluid dispensers. For at least some of these embodiments, the supply line 36 may be fluidly connected, by interference fit, to a connector 40, which may be aligned with the funnel shaped landing 8 and have a interference fit with the opening 6 of the dip tube 2, within the funned shaped landing 8, as illustrated in FIG. 5, in which the funnel shaped landing top edge 9 is substantially near the top of the fitment 34, and FIG. 6, in which the landing 8 and landing top edge 9 is substantially near the bottom of the fitment 34. The connector 40 may be supported by a connector support 42 in the trigger understructure 44, or may instead be supported by the supply line 40 itself, or another suitable structure. For embodiments in which the fitment of the container 100 requires a rotation to lock the fitment (e.g., a screw-type fitment), the connector 40 may allow tor continued alignment with the dip tube 2 as the fitment is rotated. An example of a connector 40 that may be useful in embodiments of the present invention is described in commonly owned U.S. patent application Ser. No. 12/616,282, published U.S. Pat. App. 2011/0108581, incorporated herein by reference.

Figure 7:
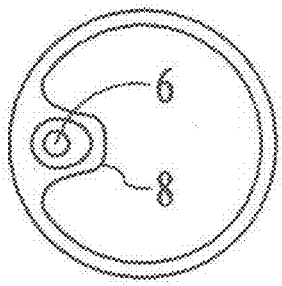
FIG. 7 shows a plan view of the top of another fluid dispensing container, in accordance with various embodiments of the present disclosure.
Figure 8:
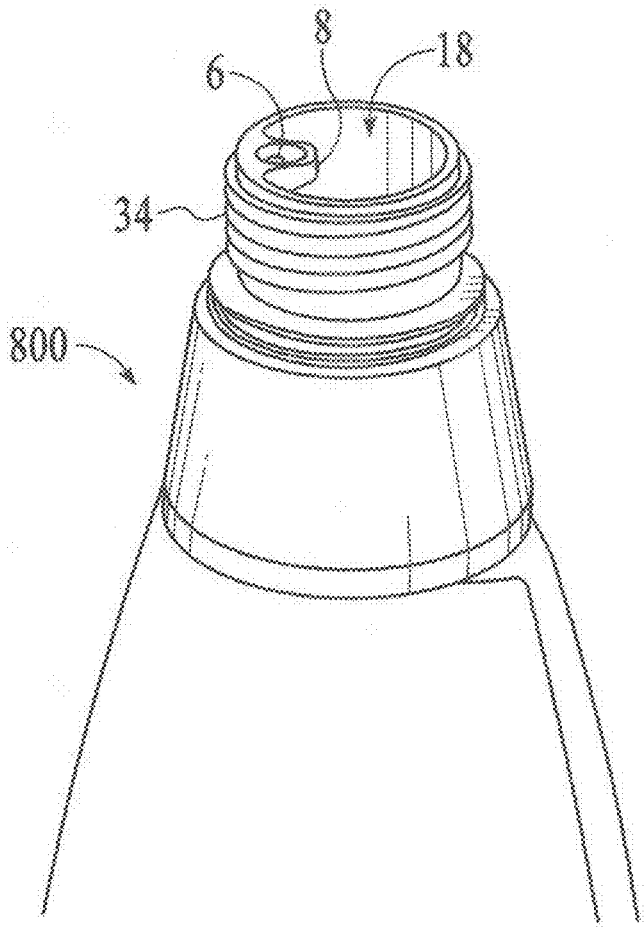
FIG. 8 shows a perspective view of the fluid dispensing container of FIG. 7.

As shown, the landing 8 may be funnel shaped, rather than being flat, with one or more sides of the landing 8 slanting inwards towards the dip tube top opening 6. To facilitate understanding of the general shape of the landing 8 and neck top 10 in various embodiments, FIGS. 7 and 8 are views depicting an opening 18 of a container 800, showing the landing 8 and the dip tube top opening. Although various other configurations may be similarly suitable, the funnel-shaped configuration may facilitate high-speed assembly of the container 100, 200 and the fluid dispenser 30 as the funnel shape may act as a guide for the supply line 36 of the fluid dispenser 30.

As shown in FIGS. 2-6, the containers 200, 300, 400 may include a snap-fit fitment 34 for coupling to a complementary snap-fit attachment connector 32 of the fluid dispenser 30. The snap-fit or bayonet-type fitment 34 may include elements similar to elements of the connector system described in commonly-owned U.S. patent application Ser. No. 12/142,000, published as U.S. Pat. App. 2009/0314811, incorporated herein by reference, except for those parts, if any, that are inconsistent with this application. Alternatively, a container may include a threaded (screw-type) fitment for coupling the container to a corresponding threaded attachment connecter of a fluid dispenser 30. An example of a snap-fit mechanism that may be useful in embodiments of the present invention is described in commonly owned U.S. patent application Ser. No. 12/142,090, published as U.S. Pat. App. 2009/0314811, incorporated herein by reference.

In various embodiments, the neck top 10 may have a substantially continuous circular shape (i.e., without breaks) (see, for example, FIG. 7). The fitment 34 may be similarly configured as a continuous circular shape below the neck top, about the opening 18 of the container.

While other types of connections may be suitable for various embodiments, the use of a snap-fit connection may provide, once the dispenser is aligned with the container, for alignment of the supply line with the dip tube as well as attachment and sealing of the dispenser with the container, with a single motion. Containers having integral dip tubes with screw caps may require a user to first align the dispenser with the dip tube and then twist the cap to provide a seal. These conventional containers may also require the user to maintain the alignment of the dip tube with the dispenser, sometime using guides, while the screw cap is tightened onto the container, and such alignment of the dip tube with the dispenser may be lost due to the torque applied to the screw cap. The snap-fit connection of various embodiments of the present invention, when applied to a container having an integral dip tube, may be simply snapped in place, without the need to apply torque to the cap to seal the cap, as is required with conventional screw caps.

Moreover, these conventional containers may require a means to move the fluid from the side of the open top part of the container (where the integral dip tube is located), to a central portion of the dispenser. With the use of a forward fluid dispenser according to various embodiments of the present invention, this fluid moving means otherwise required by conventional containers may be avoided.

Figure 9:
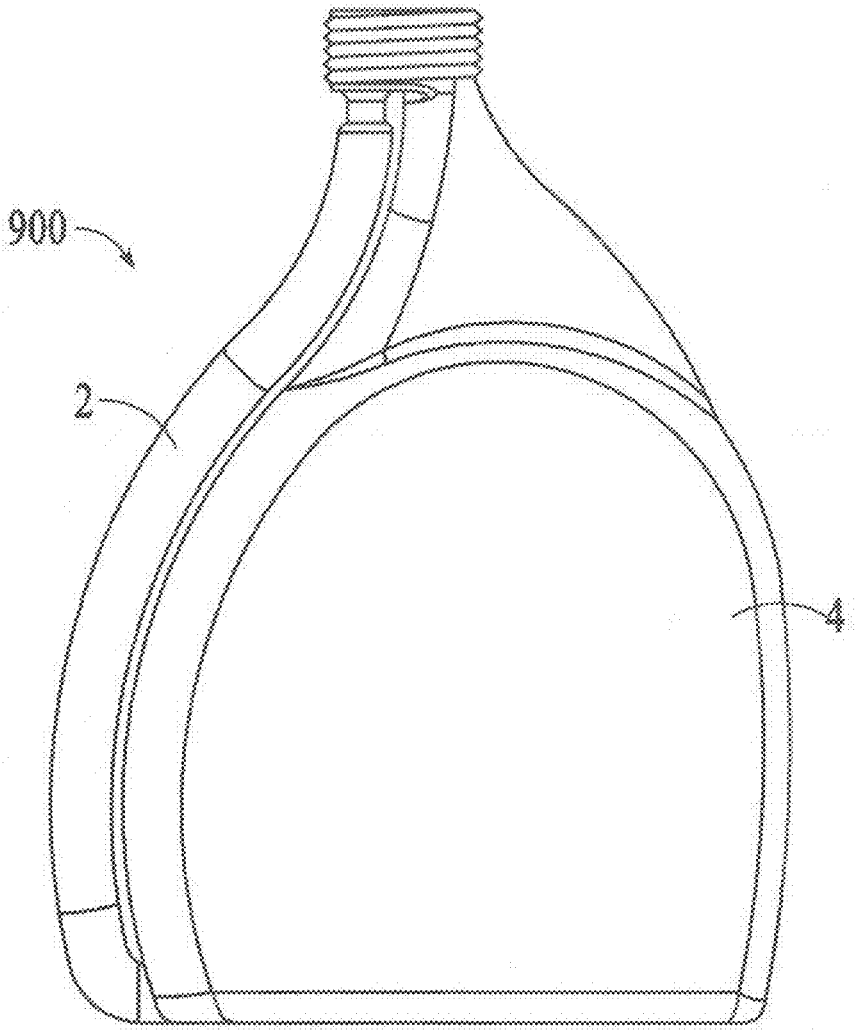
FIG. 9 shows a side elevation view of another fluid dispensing container, in accordance with various embodiments of the present disclosure.

For the embodiments illustrated in FIGS. 1-8, the dip tube 2 may be separated from the interior volume 16 by a partition wall 20. In various embodiments, as illustrated in FIG. 9, the dip tube 2 may be completely separated, in part, from the wall 4 of the container 900. In various embodiments, it may be preferable for the dip tube 2 to be separated from the wall 4 by the partition wall 20 as this combination may provide increased stiffness to the container, allowing lighter weight to meet the same load requirements.

Figure 10:
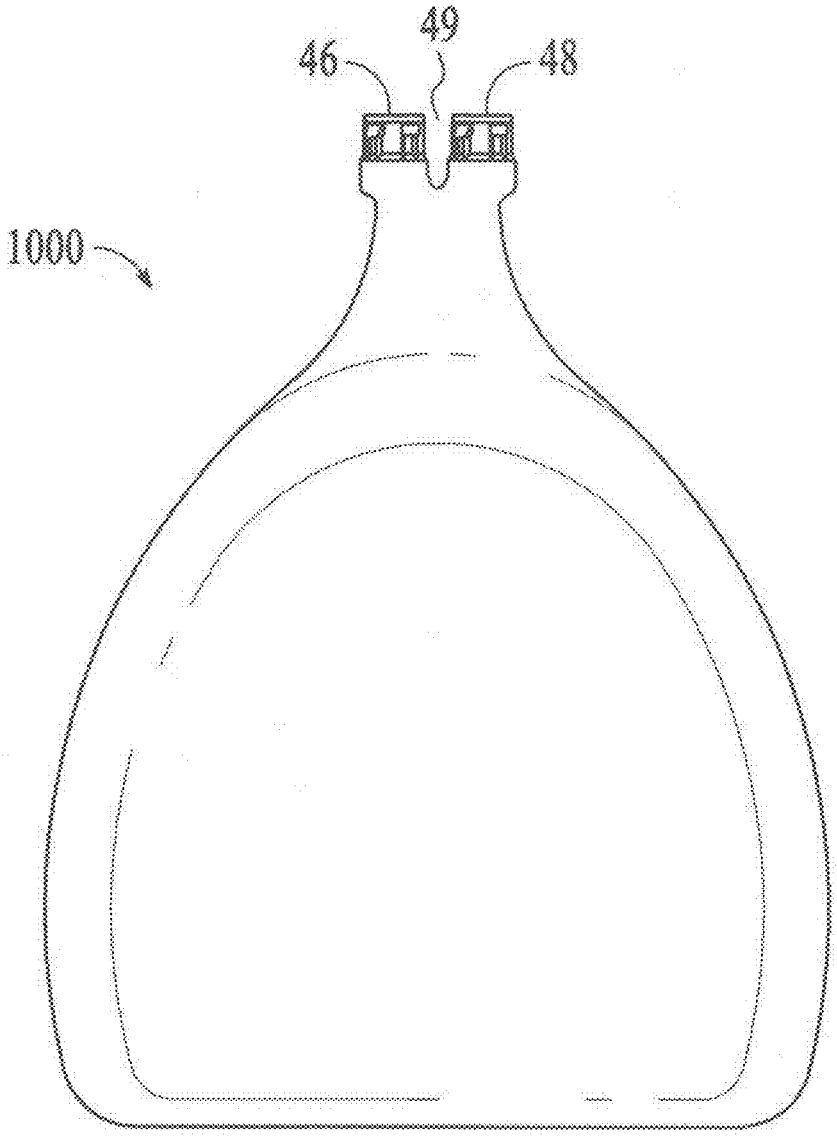
FIG. 10 shows a side elevation view of yet another fluid dispensing container, in accordance with various embodiments of the present disclosure.
Figure 11:
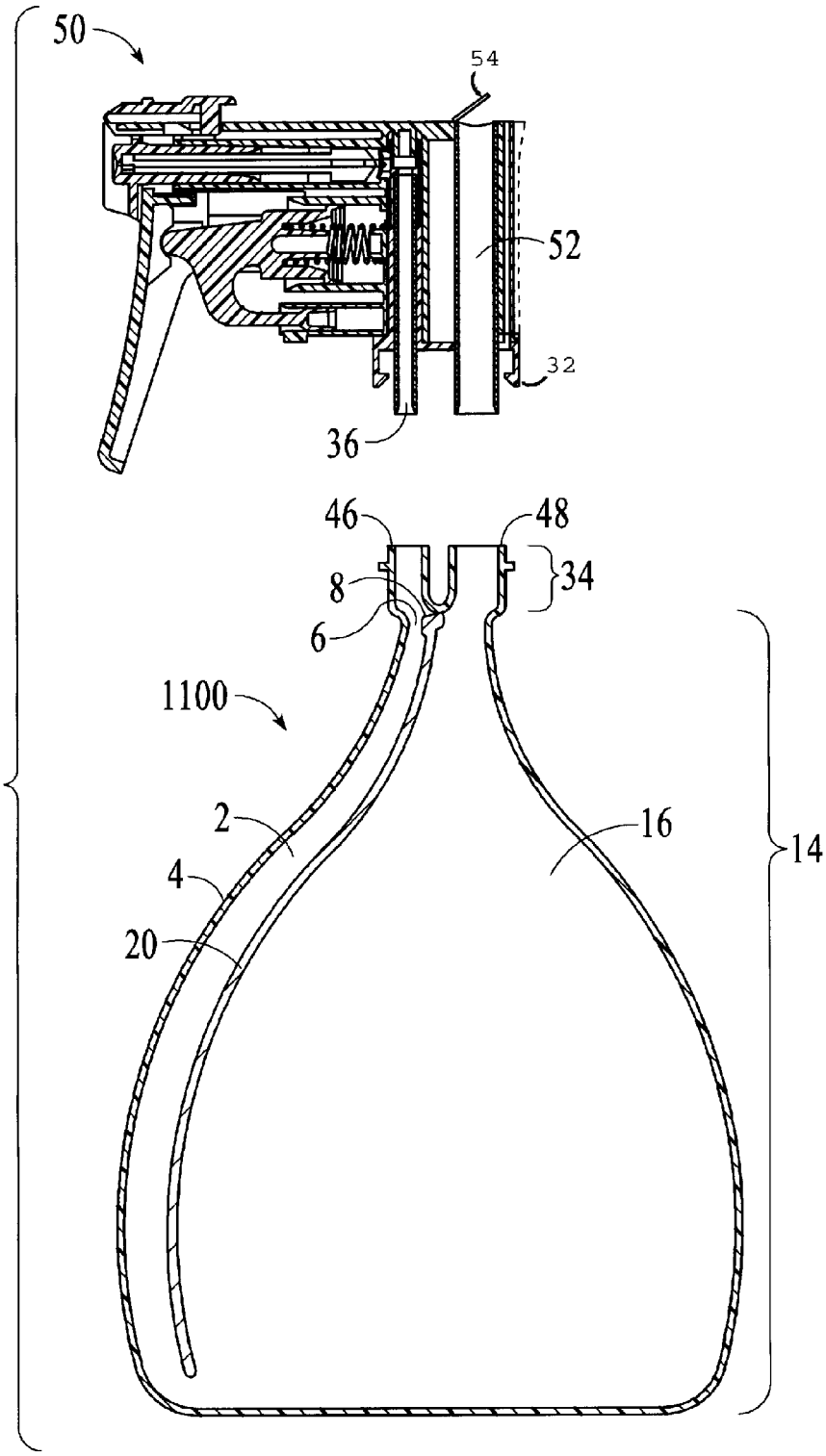
FIG. 11 shows a sectional side elevation view of the container of FIG. 10.

FIGS. 10 and 11 illustrate an embodiment in which the container 1000 includes a first neck 46 and a second neck 48 separated from the first neck 46 by a gap 49. As with various embodiments of containers described herein, the container 1000 may include a wall 4 defining an interior volume 16 and a dip tube 2 integrally formed to the body 14 (FIG. 11). The dip tube 2 may be separated from the interior volume 16 by a partition wall 20 and may be fluidly connected to the interior volume 16 at a bottom of the interior volume 16.

Figure 12:
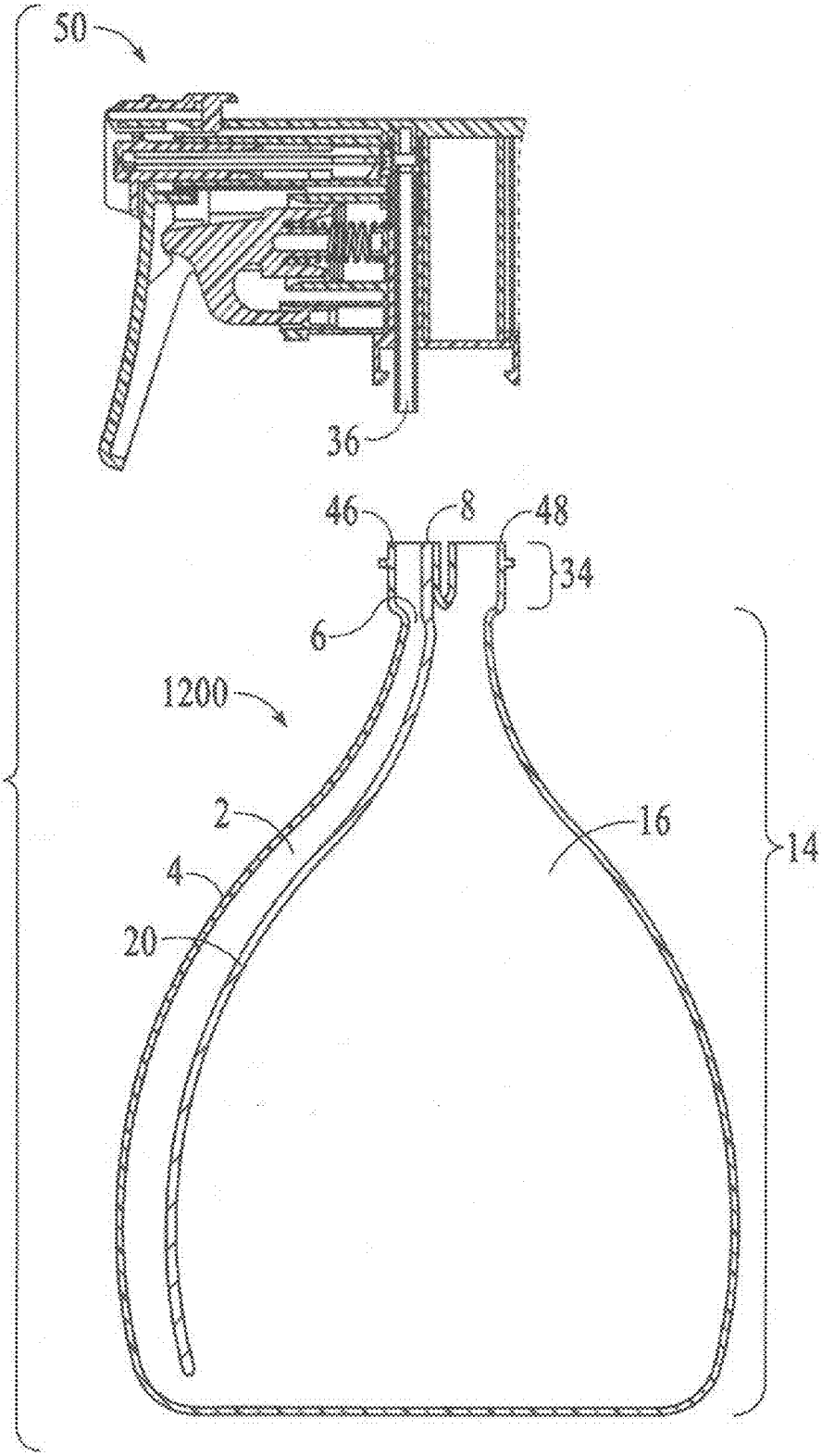
FIG. 12 shows a sectional side elevation view of another fluid dispensing container, in accordance with various embodiments of the present disclosure.

The dip tube 2 may be fluidly connected to the interior volume 16 at a landing 8 at or below a top of the first neck 46. For the embodiment illustrated in FIG. 11, the landing 8 is disposed below the top of the first neck 46. As shown, the distance between the top of the first neck 46 and the landing 8 is substantially the same as the length of the fitment 34. In various embodiments, the landing 8 may be formed at or below the top of the top of the first neck 10 such that the distance between the top of the first neck 46 and the landing 8 may be equal to or less than a length of a fitment 34 of the container 1000. In various embodiments, for example, the landing 8 may be located substantially even with the top of the first neck 46, as shown for the container 1200 of FIG. 12. In other embodiments, the landing 8 may be located between the top of the first neck 46 and the bottom of the fitment 34.

The container 1000 may be coupled to a fluid dispenser 50 such as, for example, the trigger-type dispenser as shown. The fluid dispenser 50 may include an exit post 38, an attachment connector 32, a supply line 36, and a refill channel 52. The supply line 36 may comprise a flexible connector tube that can be fluidly connected to the opening 6 of the dip tube 2.

The refill channel 52 may be formed through the fluid dispenser 50 as shown. The refill channel 52 may allow a user to add fluid to the container 1000. The refill channel 52 may have a cover 54 to fluidly seal fluid within the container 1000. The refill channel 52 may be located to the rear of the fluid dispenser 50 (relative to the direction of fluid expulsion from the exit port 38 of the fluid dispenser 50). In various other embodiments, the refill channel 52 may be located in a position other than that shown in FIG. 11. In various embodiments, the location of the refill channel 52 may be dictated by the location of the second neck 48.

The refill channel 52 may have a constant cross-sectional area along the length thereof as shown. Alternatively, the refill channel 52 may have a larger cross-sectional area at one end thereof (not shown). In various embodiments, a larger opening may allow the user to more easily pour contents into the container 1000 with less spillage, as may occur with a smaller opening.

The fluid dispenser 50 with a refill channel 52 may allow a user to purchase a single container 1000 and fluid dispenser 50 and refill the container 1000 when it becomes empty. This may save the consumer money with each refill and may also reduce solid wastes, providing consumers with a "green" alternative to buying a new container and fluid dispenser each time it becomes empty.

Various aspects of the refill channel 52 may be similar to the trigger-type dispenser described in commonly-owned U.S. patent application Ser. No. 12/254,144, incorporated herein by reference, except for those parts, if any, that are inconsistent with this application.

The supply line 36 of the fluid dispenser 50 may be located such that the supply line 36 substantially lines up with the opening 6 of the dip tube 2, as shown, or may be located elsewhere. For embodiments in which the supply line 36 does not substantially line up with the opening 6, the supply line 36 may be fluidly connected, by interface fit, to a connector (such as connector 40 shown FIGS. 5 and 6).

The landing 8 may be funnel shaped, rather than being flat, with one or more sides of the landing 8 slanting inwards towards the dip tube top opening 6. As noted herein, although various other configurations may be similarly suitable, the funnel-shaped configuration may facilitate high-speed assembly of the container 1000 and the fluid dispenser 50 as the funnel shape may act as a guide for the supply line 36 of the fluid dispenser 50.

The fluid dispenser 50 may be attached to the container 1000 by any conventional means, snob as a snap-fit connection, as shown, a threaded/screw-type connection (not shown), or a bayonet-fit (not shown). The container 1000 may include a fitment 34 configured to couple with the attachment connector 32 of the fluid dispenser 50. Alternatively, a container may include a threaded or bayonet-type fitment for coupling the container to a corresponding threaded or bayonet-type attachment connector of a fluid dispenser 50.

The fluid dispenser 50 may be configured to fit over both the first neck 46 and the second neck 48, as shown, or may instead be configured to fit over just the first neck 46 (not shown). For the embodiment shown, the fitment 32 may be configured to be mounted to the attachment connector 32 of the fluid dispenser 50. In these embodiments, the gap between the first neck top 46 and the second neck top 48 may be less than 1 inch, such as, for example, ⅛ of an inch. For embodiments in which the fluid dispenser 50 only fits over the first neck 46, a fluid dispenser 50 may not include a refill channel 52, but may instead be similar to the fluid dispenser 30 shown in FIGS. 5 and 6. A cap or another type of closure (not shown) may be used for covering the second neck 48.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the appended claims.

What is claimed is:

1. A fluid dispensing apparatus comprising:

a body having a wall defining an interior volume, a first neck, a second neck, and a fitment;

a dip tube, integrally formed to the body, fluidly connected to the interior volume at a bottom of the interior volume, and fluidly connected to the interior volume at a landing having a landing top edge at or below the top of the first neck, wherein a distance between the landing top edge and the top of the first neck is equal to or less than a length of the fitment, and wherein the landing top edge is between the top of the first neck and a bottom end of the fitment; and a dispenser configured to couple to the fitment and to fluidly connect to the dip tube at the landing.

2. The apparatus of claim 1, wherein the dispenser includes a supply line directly connected with the dip tube when the dispenser is attached to the top of the first neck.

3. A fluid dispensing apparatus comprising:

a body having a wall defining an interior volume, a first neck, a second neck, and a fitment;

a dip tube, integrally formed to the body, fluidly connected to the interior volume at a bottom of the interior volume, and fluidly connected to the interior volume at a landing having a landing top edge at or below the top of the first neck, wherein a distance between the landing top edge and the top of the first neck is equal to or less than a length of the fitment, and wherein the landing top edge is substantially level with a bottom end of the fitment; and a dispenser configured to couple to the fitment and to fluidly connect to the dip tube at the landing.

4. A fluid dispensing apparatus comprising:

a body having a wall defining an interior volume, a first neck, a second neck, and a fitment;

a dispenser configured to couple to the fitment and to fluidly connect to a dip tube; and the dip tube is integrally formed to the body, fluidly connected to the interior volume at a bottom of the interior volume, and fluidly connected to the interior volume at a landing having a landing top edge at or below the top of the first neck, wherein a distance between the landing top edge and the top of the first neck is equal to or less than a length of the fitment, wherein the landing top edge is between the top of the first neck and a bottom end of the fitment.

5. The apparatus of claim 4, wherein the dispenser comprises a refill channel.

6. The apparatus of claim 4, wherein the dispenser includes a supply line directly connected with the dip tube top opening when the dispenser is attached to the neck top.

7. A fluid dispensing apparatus comprising a body having a wall defining an interior volume, a first neck, a second neck, and a fitment;

a dispenser configured to couple to the fitment and to fluidly connect to a dip tube; and the dip tube is integrally formed to the body, fluidly connected to the interior volume at a bottom of the interior volume, and fluidly connected to the interior volume at a landing having a landing top edge at or below the top of the first neck, wherein a distance between the landing top edge and the top of the first neck is equal to or less than a length of the fitment, and wherein the landing top edge is substantially level with a bottom end of the fitment.

8. The apparatus of claim 4, wherein the fitment is a snap-fit fitment.

9. The apparatus of claim 4, wherein the fitment is a threaded fitment.

* * * * *